US009617110B2

(12) United States Patent
Sekigawa

(10) Patent No.: US 9,617,110 B2
(45) Date of Patent: Apr. 11, 2017

(54) SHEET FEEDING APPARATUS AND IMAGE FORMING APPARATUS WITH PRESSING PORTION

(71) Applicant: CANON KABUSHIKI KAISHA, Tokyo (JP)

(72) Inventor: Akito Sekigawa, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 6 days.

(21) Appl. No.: 14/306,359

(22) Filed: Jun. 17, 2014

(65) Prior Publication Data

US 2015/0001784 A1 Jan. 1, 2015

(30) Foreign Application Priority Data

Jun. 28, 2013 (JP) ..... 2013-136300

(51) Int. Cl.
*B65H 37/04* (2006.01)
*B65H 39/00* (2006.01)
(Continued)

(52) U.S. Cl.
CPC ..... *B65H 39/00* (2013.01); *B65H 31/26* (2013.01); *B65H 31/3081* (2013.01);
(Continued)

(58) Field of Classification Search
CPC ..... B65H 37/04
(Continued)

(56) References Cited

U.S. PATENT DOCUMENTS 6,209,864 B1 4/2001 Taniguchi et al.
7,172,194 B2 * 2/2007 Terao ..... G03B 27/74 270/58.08
(Continued)

FOREIGN PATENT DOCUMENTS

JP 2000-086056 A 3/2000
JP 2000-219399 A 8/2000
(Continued)

OTHER PUBLICATIONS

Office Action dated Aug. 18, 2015 (and English translation thereof), in Japanese Application No. 2014-131002.

*Primary Examiner* — Patrick Mackey
(74) *Attorney, Agent, or Firm* — Fitzpatrick, Cella, Harper & Scinto

(57) ABSTRACT

To suppress the bending of sheets, a sheet conveying apparatus includes a sheet conveying portion including an abutting portion for abutting against an end portion of the sheet supported by a supporting portion and which conveys the sheet being abutted against the abutting portion by moving in a predetermined moving direction, and a pressing portion which is provided on the sheet conveying portion such that the pressing portion is movable in a thickness direction of the sheet and which presses the sheet toward the supporting portion. The pressing portion includes an inclined portion arranged to be closer to the supporting portion at an upstream side than a downstream side, and a contacting portion configured to contact a surface of the sheet being abutted against the abutting portion to press the sheet to the supporting portion at a position distant from the abutting portion.

21 Claims, 19 Drawing Sheets

(51) Int. Cl.
*B65H 31/26* (2006.01)
*B65H 31/30* (2006.01)
*B65H 31/36* (2006.01)

(52) U.S. Cl.
CPC ..... *B65H 31/36* (2013.01); *B65H 2301/4212* (2013.01); *B65H 2301/4213* (2013.01); *B65H 2404/1114* (2013.01); *B65H 2404/1521* (2013.01); *B65H 2701/18292* (2013.01); *B65H 2801/27* (2013.01)

(58) Field of Classification Search
USPC ..... 270/58.08, 58.11, 58.12, 58.16, 58.17; 399/410
See application file for complete search history.

(56) References Cited

U.S. PATENT DOCUMENTS 7,461,837 B2 * 12/2008 Saito ..... B42C 1/12 270/58.07
7,487,959 B2 * 2/2009 Noh ..... G03B 27/00 198/484.1
7,556,252 B2 * 7/2009 Terao ..... B42C 1/12 270/58.07
7,661,666 B2 * 2/2010 Terao ..... G03G 15/6538 270/58.07
7,832,718 B2 * 11/2010 Fukasawa ..... B42C 1/125 270/58.07
7,862,026 B2 * 1/2011 Terao ..... B65H 29/52 270/52.16
7,866,650 B2 1/2011 Nomura et al.
7,992,856 B2 * 8/2011 Saito ..... B65H 31/3027 270/58.08
8,622,378 B2 1/2014 Sekigawa
8,708,325 B2 * 4/2014 Hwang ..... G03G 15/6538 270/58.11
8,774,702 B2 7/2014 Sekigawa
2012/0032388 A1 * 2/2012 Jung ..... B65H 31/34 270/58.08

FOREIGN PATENT DOCUMENTS

JP 2006-151519 A 6/2006
JP 2006-256726 A 9/2006
JP 2006-306564 A 11/2006
JP 2008-105849 A 5/2008
JP 2009-007095 A 1/2009
JP 4533096 B2 8/2010
JP 4796934 B2 10/2011
JP 4801915 B2 10/2011

* cited by examiner

SHEET FEEDING APPARATUS AND IMAGE FORMING APPARATUS WITH PRESSING PORTION

BACKGROUND OF THE INVENTION

Field of the Invention

The present invention relates to a sheet feeding apparatus which processes sheets on which images are formed.

Description of the Related Art

As shown in Japanese Patent Laid-Open No. 2000-219399, conventionally, in an image forming apparatus, a sheet having an image formed thereon may be discharged to the stack tray after performing post-processing such as stapling.

FIG. 18 is a diagram showing a configuration of a portion for conveying a sheet during post-processing of the image forming apparatus of the prior art.

As shown in the figure, in the conventional image forming apparatus, the rear end of the sheet bundle S on the processing tray is pushed in the direction A by the sheet bundle pushing member 60*a* provided on the belt 60 and the sheet bundle S is discharged on the stack tray.

FIGS. 19A and 19B are diagrams showing states of pushing the rear end of the sheet bundle S by the sheet bundle pushing member 60*a* in the image forming apparatus of the prior art shown in FIG. 18. FIG. 19A is a diagram showing a state in which the sheet bundle pushing member 60*a* begins to push the sheet bundle S. FIG. 19B is a diagram showing a state immediately before the sheet bundle pushing member 60*a* finishes pushing the sheet bundle S.

As shown in FIG. 19A, the sheet bundle pushing member 60*a* provided on the belt 60 pushes the trailing end of the sheet bundle S out on to the stack tray. At this time, in the case of using a sheet with a low rigidity, the sheet is easily bent in a concave portion of the sheet bundle pushing member 60*a*.

Therefore, when the sheet bundle pushing member 60*a* is stopped or decelerated immediately before discharging the sheet stack S on to the stacking tray, so-called spring-back is easy to occur in which the sheet bundle S bent when pushed by the sheet bundle pushing member 60*a* goes back to a flat state.

As shown in FIG. 19B, when spring back occurs, a problem arises wherein the sheet stack S jumps out by kicking the sheet bundle member 60*a*, which lowers the loading ability on the stacking tray.

It can be considered that kicking amount of the sheets is reduced by reducing the amount of deflection of the sheets by moving the sheet bundle pushing member 60*a* slowly. However, this causes a problem where the productivity is lowered.

SUMMARY OF THE INVENTION

An object of the present invention is to suppress deflection of a sheet and to prevent stacking ability from being deteriorated when the sheet bundle pops out due to spring-back.

To accomplish this object, a sheet conveying apparatus comprises: a supporting portion which supports a sheet; a sheet conveying portion which includes an abutting portion for abutting against an end portion of the sheet supported by the supporting portion and which conveys the sheet being abutted against the abutting portion by moving in a predetermined moving direction; and a pressing portion which is provided on the sheet conveying portion in such a way that the pressing portion is movable in a thickness direction of the sheet and which presses the sheet toward the supporting portion, wherein the pressing portion includes: an inclined portion arranged in a manner so as to be closer to the supporting portion at an upstream side in the predetermined moving direction than a downstream side in the predetermined moving direction; and a contacting portion configured to contact a surface of the sheet being abutted against the abutting portion to press the sheet to the supporting portion at a position distant from the abutting portion.

Further features of the present invention will become apparent from the following description of exemplary embodiments with reference to the attached drawings.

BRIEF DESCRIPTION OF THE DRAWINGS

FIG. 11A shows a state before the rear end assist begins to move. FIG. 11B shows a state where the rear end assist 112 has begun to move.

FIG. 12A shows a state where the discharging projection began to move. FIG. 12B shows a state where the discharging projection has overtaken a rear end assist. FIG. 12C shows a state immediately after the discharging projection discharges a sheet bundle.

FIG. 16A shows a state in which a sheet bundle is not inserted in the discharging projection and FIG. 16B shows a state in which the sheet bundle is inserted in the discharging projection.

FIG. 19A is a diagram showing a state in which the sheet bundle pushing member begins to push the sheet bundle. FIG. 19B is a diagram showing a state immediately before the sheet bundle pushing member finishes pushing the sheet bundle.

DESCRIPTION OF THE EMBODIMENTS

Embodiments for carrying out the present invention will be described in detail hereunder with reference to the drawings.

First Embodiment

The best mode for carrying out the present invention will be explained in detail with reference to the drawings.

Figure 1:
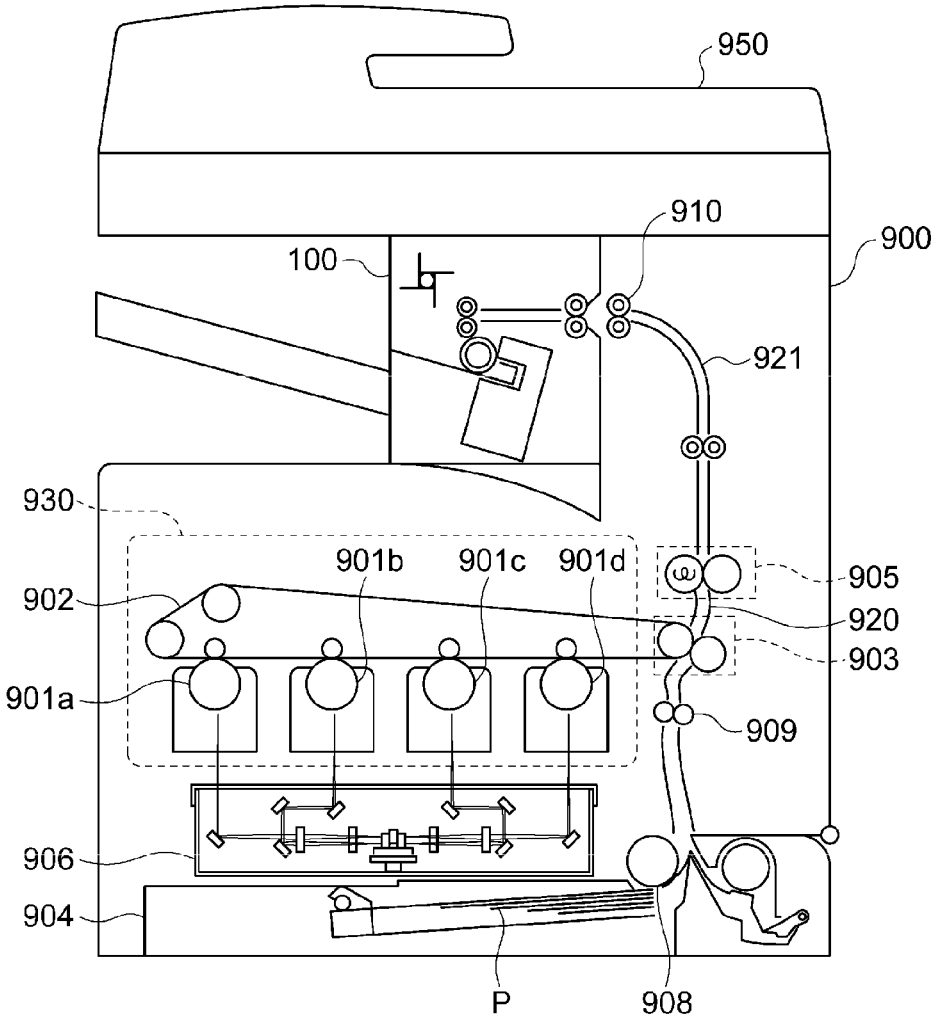
FIG. 1 is a schematic diagram illustrating an image forming apparatus of the first embodiment of the present invention.

(Schematic configuration of the image forming apparatus) FIG. 1 is a schematic diagram illustrating the image forming apparatus 900 of an embodiment of the present invention.

As shown in the diagram, the image forming apparatus 900 is provided with the document feeder 950 and finisher 100.

The image forming unit 930 forms toner images of a different color on the photosensitive drums 901*a*, 901*b*, 901*c* and 901*d* respectively and the toner images are transferred on the intermediate transfer belt 902. The exposure apparatus 906 projects a laser beam on the surfaces of the photosensitive drums 901*a*, 901*b*, 901*c* and 901*d*.

Firstly, a laser beam is projected from the exposure apparatus 906 on the photosensitive drums 901*a*, 901*b*, 901*c* and 901*d*, thereby forming electro latent images on the photosensitive drums 901*a*, 901*b*, 901*c* and 901*d*. Toner is provided on the photosensitive drums 901*a*, 901*b*, 901*c* and 901*d*, thereby visualizing the electro latent images as toner images of respective colors. Subsequently, these toner images are transferred primarily on the intermediate transfer belt 902 as the photosensitive drums 901*a*, 901*b*, 901*c* and 901*d* rotate.

On the other hand, the sheets P are stored in the cassette 904. The sheets P are fed out from the cassette 904 one by one by the pickup roller 908 and conveyed to the secondary transfer position after being timed by the registration roller 909. At the secondary transfer position, toner images of four colors on the intermediate transfer belt 902 are collectively secondarily transferred on the sheet P by the secondary transfer bias applied to the secondary transfer roller pair 903.

The sheet P on which toner images of four colors are transferred is conveyed to the fixing apparatus 905 with the guidance of the conveying guide 920, where the toner images are melted so that colors are mixed by receiving heat and pressure and consequently the toner images are fixed to the sheet P. The sheet P on which a full-color image is formed is conveyed to the finisher 100 along the conveying guide 921 by the discharge roller pair 910.

(System block diagram) Next, a configuration of a controller which controls the entire image forming apparatus 900 will be described.

Figure 2:
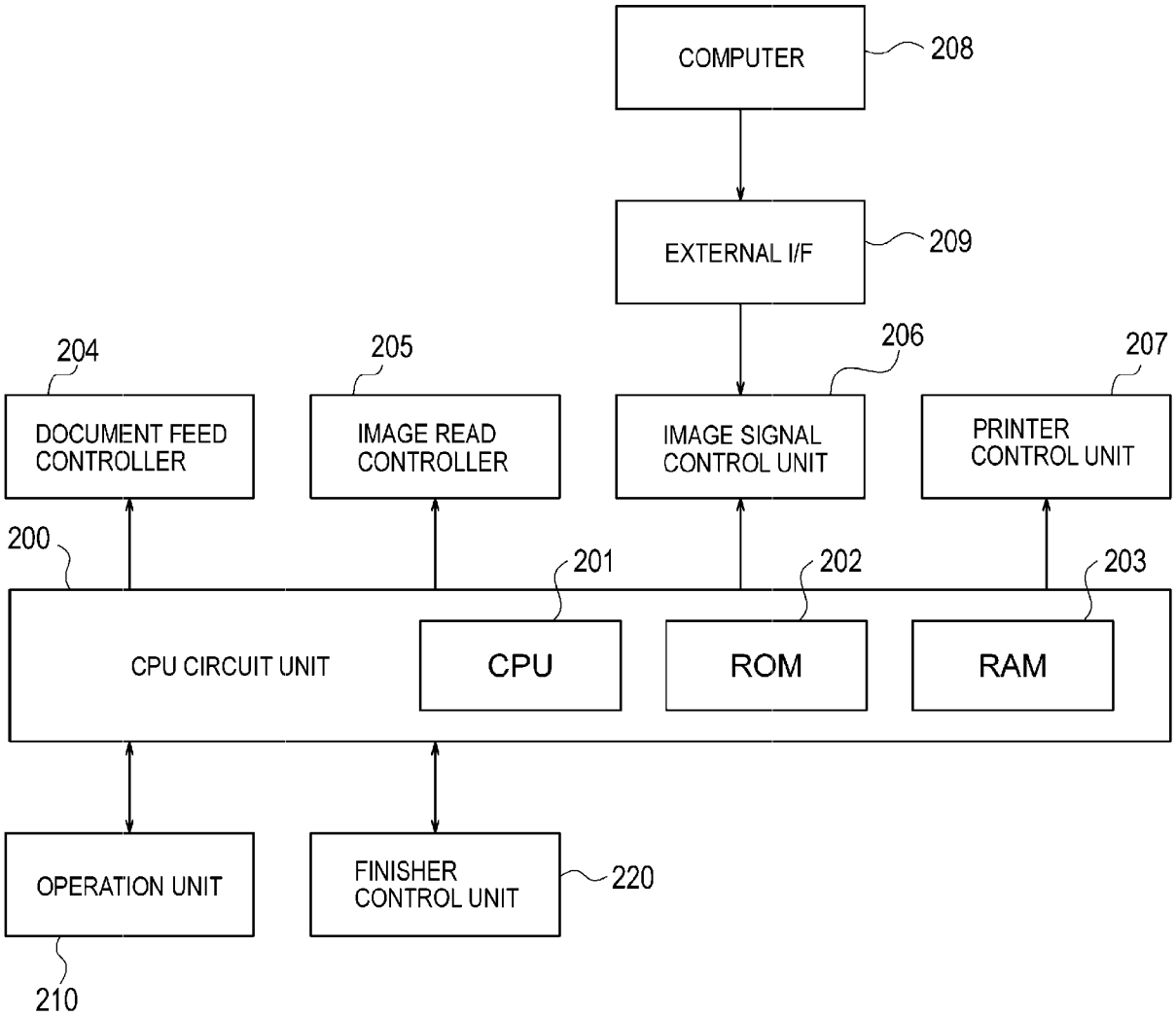
FIG. 2 is a schematic diagram illustrating a controller which controls the entire image forming apparatus of the first embodiment of the present invention.

FIG. 2 is a schematic diagram illustrating the controller which controls the entire image forming apparatus 900.

The controller described in FIG. 2 includes the CPU circuit unit 200 which incorporates the CPU 201, the ROM 202 and the RAM 203. The CPU circuit unit 200 performs overall control of each unit by a control program stored in the ROM 202. The RAM 203 temporarily stores control data and is used as a work area for arithmetic processing during control of each unit.

The document feed controller 204 performs drive control of the document feeder 950 based on an instruction from the CPU circuit unit 200. The image read controller 205 performs drive controls of a scanner unit, an image sensor and so on and transfers analog image signals output from the image sensor to the image signal control unit 206.

The image signal processing unit 206 converts analog image signals into digital signals and performs each processing for the digital signals thereafter. The digital signals subjected to each processing are converted into video signals which are output to the printer control unit 207. The image signal control unit 206 performs each processing for the digital image signals input via the external I/F 209 from the computer 208. The digital image signals subjected to each processing are converted into video signals which are output to the printer control unit 207. The processing by the image signal processing unit 206 is controlled by the CPU circuit 200. The printer control unit 207 performs exposure control based on the input video signals.

Operation unit 210 has a plurality of keys for setting various functions relating to image formation, a display unit for displaying information indicating a setting state. The operation unit 210 outputs key signals corresponding to operations of keys respectively to the CPU circuit unit 200 and displays at the display unit the corresponding information based on signals from the CPU circuit unit 200.

The finisher control unit 220 performs drive control of the finisher 100 by exchanging information with the CPU circuit unit 200. The finisher control unit 220 controls various motors and sensors.

Next, the finisher control unit 220 which performs drive control of the finisher 100 will be described.

Figure 3:
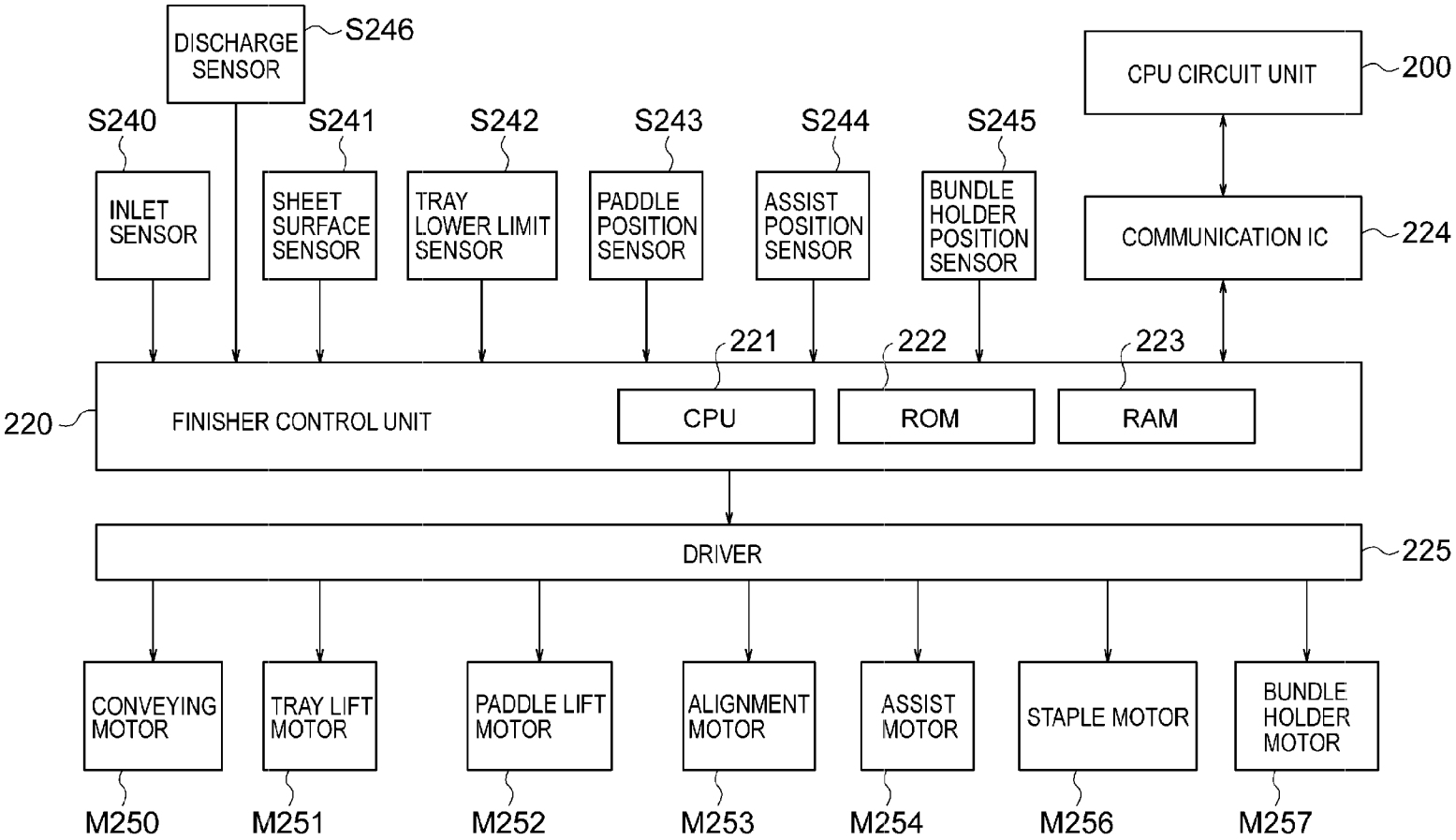
FIG. 3 is a diagram showing a configuration of a finisher control unit, motors and sensors connected to the finisher control unit of the image forming apparatus of the first embodiment of the present invention.

FIG. 3 is a diagram showing a configuration of the finisher control unit 220, motors and sensors connected to the finisher control unit 220.

As shown in the diagram, the finisher control unit 220 is constituted of the CPU 221, the ROM 222, and the RAM 223. The finisher control unit 220 exchanges data by communicating via the communication IC 224 with the CPU circuit unit 200 provided in the main body of the image forming apparatus 900. The finisher control unit 220 performs drive control of the finisher 100 by executing various programs stored in the ROM 222 based on an instruction from the CPU circuit unit 200.

In performing drive control of the finisher 100, detection signals from various sensors are taken into the finisher control unit 220.

The various sensors include the inlet sensor S240, the sheet surface sensor S241, the tray lower limit sensor S242, the paddle position sensor S243, the assist position sensor S244, the bundle holder position sensor S245 and the discharge sensor S246. The driver 225 drives the conveying motor M250, the tray lift motor M251, the paddle lift motor M252, the alignment motor M253, the assist motor M254, the staple motor M256 and the bundle holder motor M257 based on signals from the finisher control unit 220.

Operations of the above sensors and motors will be explained later in detail.

(Structure and operation of the finisher) Next, the structure and the operation of the finisher 100 will be described with reference to the FIGS. 4 to 8.

Figure 4:
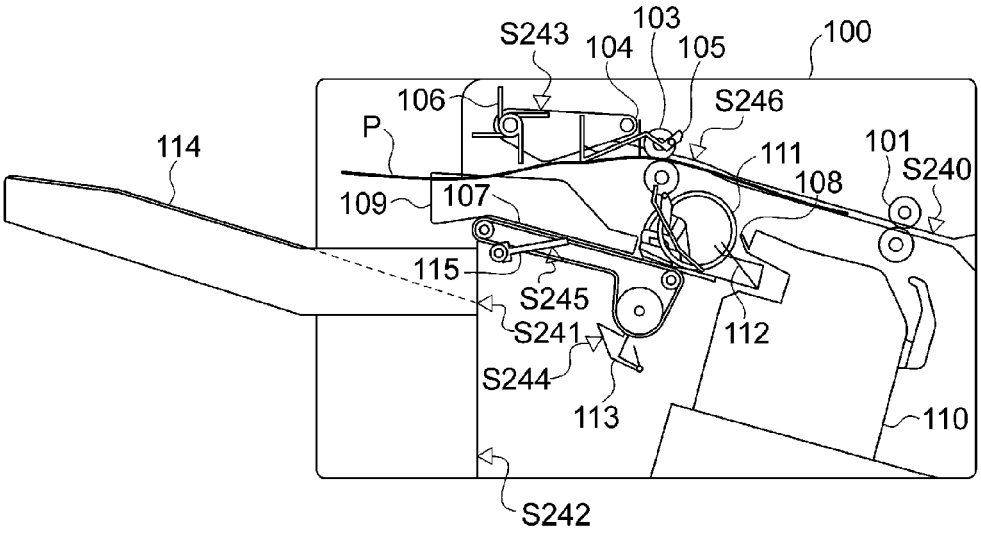
FIG. 4 is a diagram showing a state in which a sheet discharged from a main body of the image forming apparatus of the first embodiment of the present invention is introduced into a finisher.

FIG. 4 is a diagram showing a state in which the sheet P discharged from the main body of the image forming apparatus 900 is introduced into the finisher 100.

As shown in the diagram, the sheet P discharged from the main body of the image forming apparatus 900 is delivered to the inlet roller 101 and is conveyed to the conveying path of the finisher 100. The inlet roller 101 is driven by the conveying motor M250.

At this time, the delivery timing of the sheet P is controlled by detecting the front end of the sheet P by the inlet sensor S240. The sheet P is delivered to the discharge roller 103 where the sheet P is conveyed while the front end portion of the sheet P lifts the rear end drop 105. At the same time, the sheet P is transported to the processing tray 107 (holding tray) while charge of the sheet P is removed by the charge removing needle 104. The sheet P discharged onto the processing tray 107 by the discharge roller 103 is pushed from the upper side to the lower side by the weight of the rear end drop 105, thereby reducing the amount of the time during which the rear end portion of the sheet P falls onto the processing tray 107. The finisher control unit 220 controls a finishing process performed in the processing tray based on a signal indicative of the rear end of the sheet P detected by the discharge sensor S246.

Figure 5:
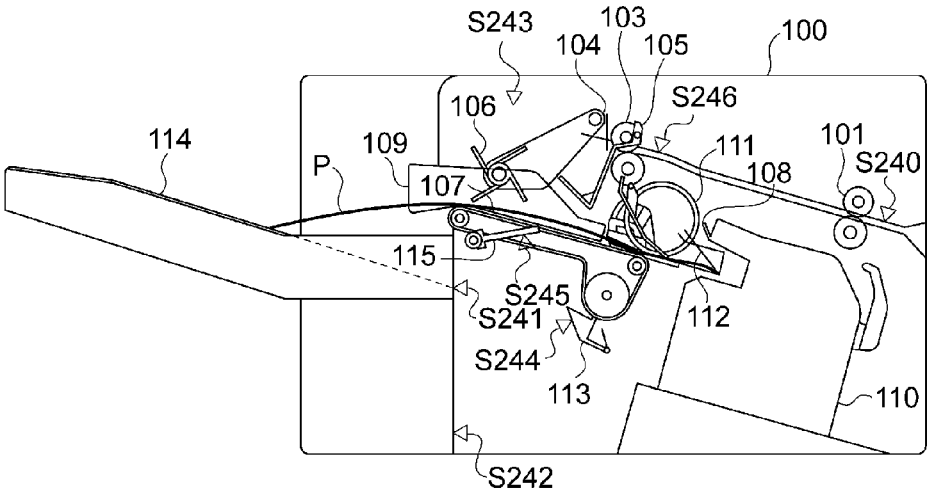
FIG. 5 is a diagram showing a state in which a sheet has fallen onto a processing tray and has been transported to a direction of a rear end stopper side in the image forming apparatus of the first embodiment of the present invention.

FIG. 5 is a diagram showing a state in which the sheet P has fallen onto the processing tray 107 and has been transported to the direction of the rear end stopper 108 side.

As shown in the diagram, when the sheet P has fallen onto the processing tray 107, the paddle 106 moves downward to the processing tray 107 side around the rotating shaft. This downward movement is performed by rotation of the paddle lift motor M252.

The paddle 106 is rotated in the counterclockwise direction by the conveying motor M250 and the paddle 106 comes into contact with the sheet P, thereby conveying the sheet P to the rear end stopper 108 side in the right direction in the figure.

When the rear end of the sheet P is delivered to the knurled belt 111, the paddle 106 is moved in the upward direction by the paddle lift motor M252. When the paddle position sensor S243 detects that the paddle 106 reaches the top position, the drive of the paddle is stopped. After the knurled belt 111 conveys the sheet P to the rear end stopper 108, the knurled belt 111 continues to convey the sheet P while slipping with respect to the sheet P, thereby a force toward the rear end stopper 108 side is always applied to the sheet P. This slip transport enables skew adjustment of the sheet P by making the sheet P abut against the rear end stopper 108.

Figure 6:
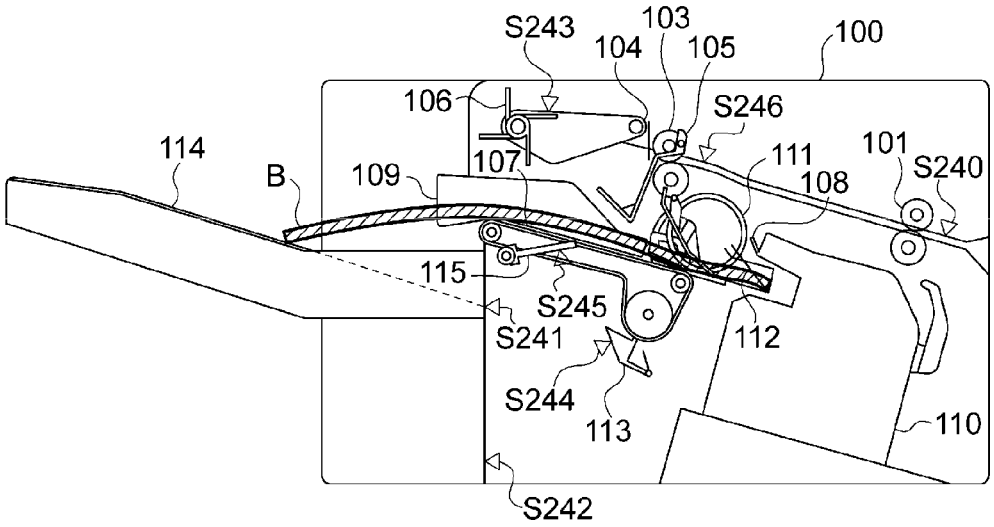
FIG. 6 is a diagram showing a state in which a sheet bundle consisting of a plurality of sheets has been stacked on the rear end stopper side of the processing tray in the image forming apparatus of the first embodiment of the present invention.

FIG. 6 is a diagram showing a state in which the sheet bundle B consisting of a plurality of sheets P has been stacked on the rear end stopper 108 side of the processing tray 107.

As shown in the diagram, the sheets of the sheet bundle B abutted against the rear end stopper 108 are aligned in the width direction by the alignment plate 109 (sheet aligning portion) which is moved in the direction perpendicular to the conveying direction by the alignment motor M253. By repeating this series of operations, the sheets of the sheet bundle B is aligned on the processing tray 107.

After the predetermined number of sheets P are formed as the sheet bundle B, the staple motor M256 for driving the stapler 110 is driven when carrying out a binding process of the sheet bundle B using staples. When a binding process of the bundle B is not performed, the operation proceeds to the next process of discharging the sheet bundle without performing a binding process.

Figure 7:
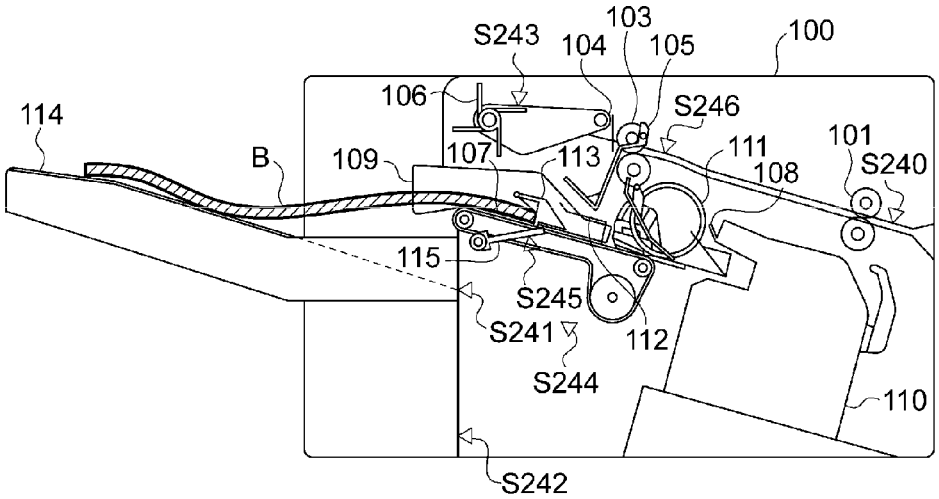
FIG. 7 is a diagram showing a state in which a sheet bundle discharging process is performed in the image forming apparatus of the first embodiment of the present invention.

FIG. 7 is a diagram showing a state in which a sheet bundle discharging process is performed.

As shown in the diagram, discharge of the sheet bundle B is performed by pushing rear end of the sheet bundle B with the rear end assist 112 (moving member) and discharging projection 113 (sheet conveying member, discharging portion). Thereby, the sheet bundle B on the processing tray 107 (supporting portion) is discharged on the stacking tray 114 in a state of bundle. The rear end assist 112 and the discharging projection 113 are driven by the assist motor M254.

A detailed structure of the sheet bundle discharging unit having the rear end assist 112 and the discharging projection 113 will be explained later.

Figure 8:
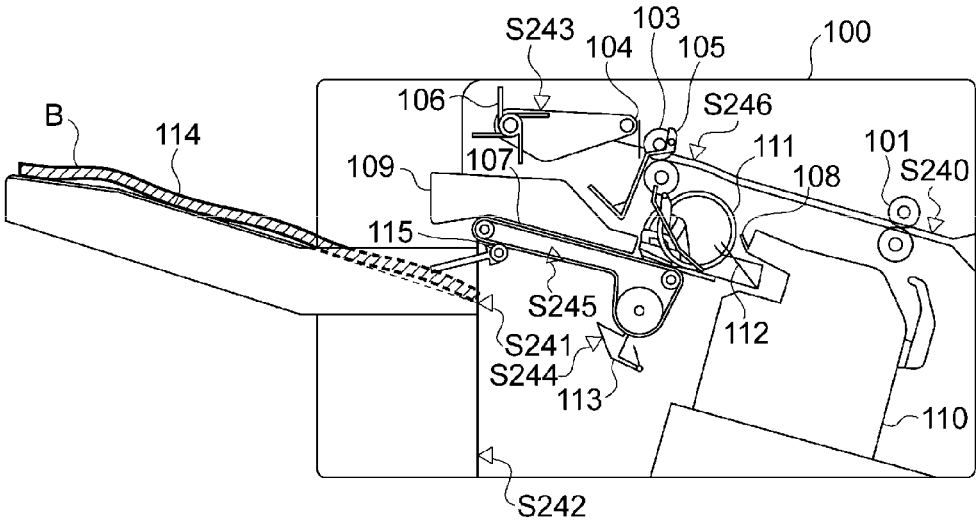
FIG. 8 is a diagram illustrating a state in which a discharged sheet bundle is stacked on a stacking tray in the image forming apparatus of the first embodiment of the present invention.

FIG. 8 is a diagram illustrating a state in which a discharged sheet bundle is stacked on the stacking tray 114.

As shown in the diagram, to prevent the sheet bundle B stacked on the stacking tray 114 from being pushed out in the conveying direction by the subsequently discharged sheet bundle B, the bundle holder 115 is rotated counterclockwise by the bundle holder motor M257 for holding the rear end portion of the sheet bundle B. The position sensor S245 detects that the bundle holder is in the predetermined retracted position and the bundle holder 115 is kept in this position when there is no need of holding the sheet bundle.

After completion of the bundle holding operation, when the sheet bundle B is shielding the sheet surface sensor S241, the stacking tray 114 is lowered by the tray lift motor M251 until the sheet surface sensor S241 becomes in a transmission state.

By repeating the series of operations so far, a required number of copies of the sheet bundles B can be discharged to the stacking tray 114.

When the stacking tray 114 is lowered and shields the tray lower limit sensor S242 during operation, a signal indicating that the stacking tray 114 is full is notified to the CPU circuit unit 200 of the image forming apparatus 900 by the finisher control unit 220 and the image forming process is stopped. When the sheet bundle on the stacking tray 114 is removed, the stacking tray 114 is moved in the upward direction until the sheet surface sensor S241 detects a light-shielding, and then the stacking tray 114 is moved in the downward direction until the sheet surface sensor S241 detects a light transmission, thereby the position of the sheet on the stacking tray 114 is determined again. After that, the image forming process of the image forming apparatus 900 is resumed.

Figure 9:
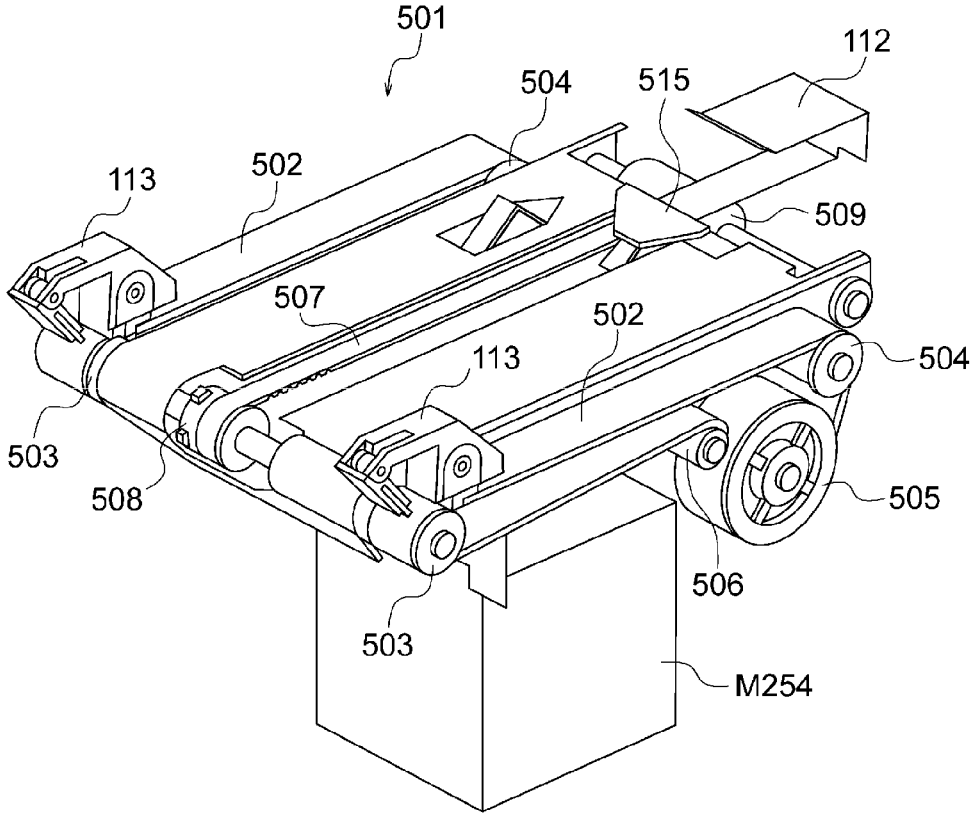
FIG. 9 is a perspective view of a sheet bundle discharging unit which includes a rear end assist and discharging projection, both are for discharging sheets stacked on the processing tray onto the stacking tray in the image forming apparatus of the first embodiment of the present invention.

(Structure of the sheet bundle discharging unit) FIG. 9 is a perspective view of a sheet bundle discharging unit 501 which includes the rear end assist 112 and the discharging projection 113, both are for discharging sheets stacked on the processing tray 107 onto the stacking tray 114.

As shown in the figure, the discharging projection 113 is coupled to the discharging projection belt 502. These are arranged on the processing tray 107 two by two in the width direction orthogonal to the sheet conveying direction. The discharging projection belt 502 which is an endless belt is stretched by the pulleys 503, 504 and the cam pulley 505, which are a rotating member. Tension of the discharging projection belt 502 is added by the tensioner 506. The belt surfaces of the discharging projection belts 502 are formed along the stacking surface of the processing tray 107 between the pulleys 503 and 504.

The assist rear end 112 is coupled to the assist belt 507 through the assist slider 515 and the assist belt 507 is applied on the pulleys 508 and 509.

Figure 10:
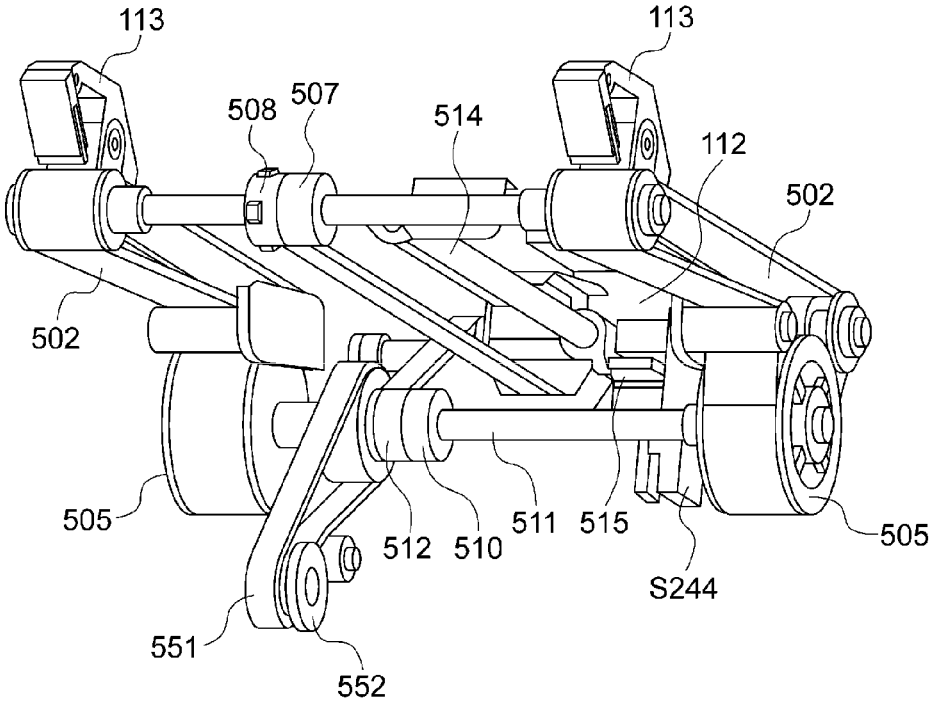
FIG. 10 is a perspective view showing a configuration of a driving unit for moving an assist belt and the discharging projection belt in the image forming apparatus of the first embodiment of the present invention.

FIG. 10 is a perspective view showing a configuration of a driving unit for moving the assist belt 507 and the discharging projection belt 502.

The assist motor pulley 552 is connected to the axis of the assist motor M254 (not shown in FIG. 10). As shown in FIG. 10, driving force of the assist motor M254 is transmitted via the drive belt 551 to the stepped pulley 510 on the assist cam shaft 511 which is located in the center of rotation of the cam pulley 505. Further, this driving force is transmitted via the drive belt 512 and the stepped pulley 510 coaxially to a pulley 509 (shown in FIG. 9) to which the assist belt 507 is applied.

In the above configuration, the assist belt 507 and the discharging projection belt 502 are driven by the assist motor M254.

The assist slider 515 which is coupled to the rear end assist 112 is slidably disposed on the slider shaft 514. The assist slider 515 has a sensor flag for detecting a position of the rear end assist 112 by turning off the assist position sensor S244.

(Structure and operation of cam pulley) Next, a structure and an operation of the cam pulley 505 will be explained.

Figure 11A:
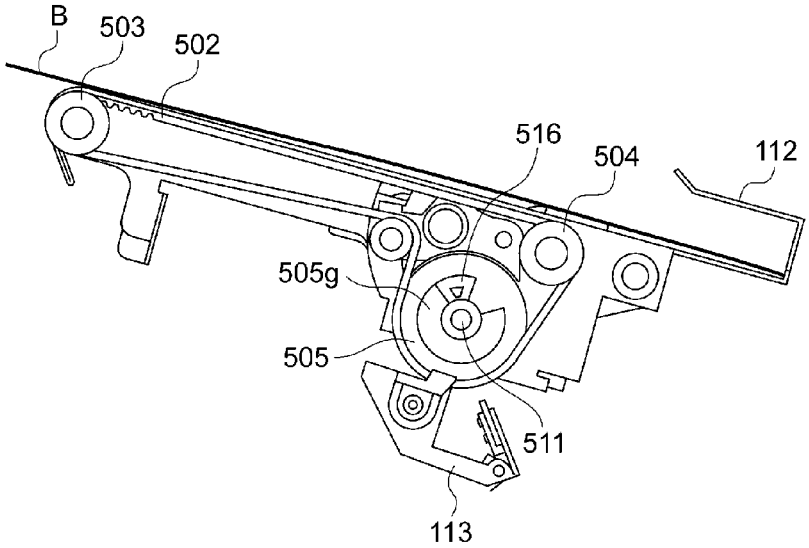
FIGS. 11A and 11B show a state before a discharging projection begins to move in the image forming apparatus of the first embodiment of the present invention.
Figure 11B:
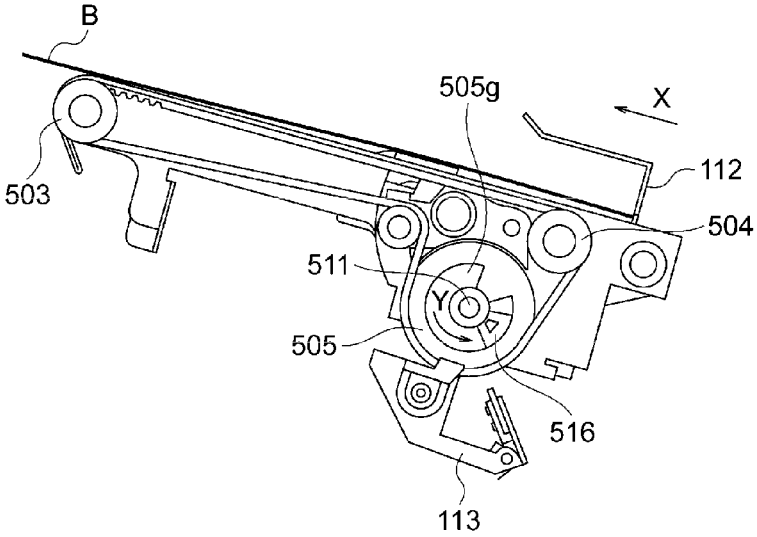
Figure 12A:
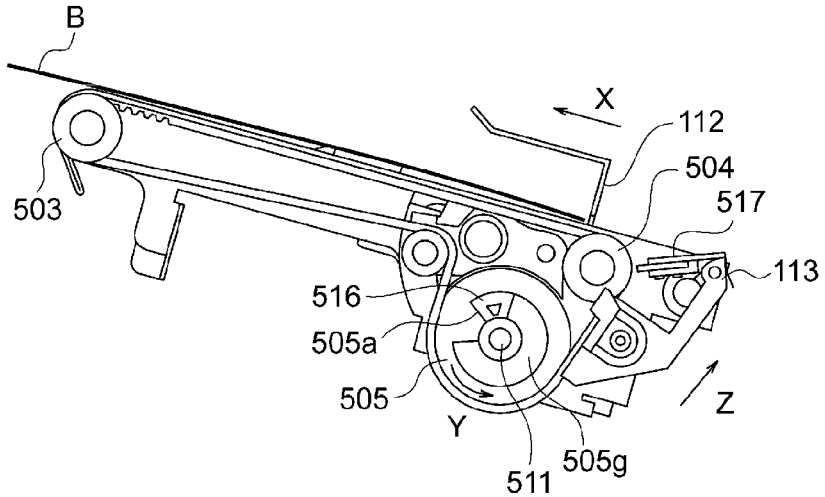
FIGS. 12A, 12B and 12*c* show a state after the discharging projection began to move in the image forming apparatus of the first embodiment of the present invention.
Figure 12B:
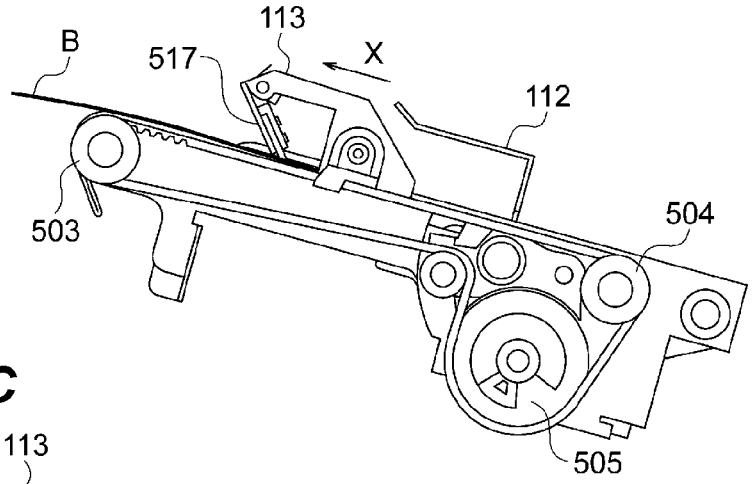
Figure 12C:
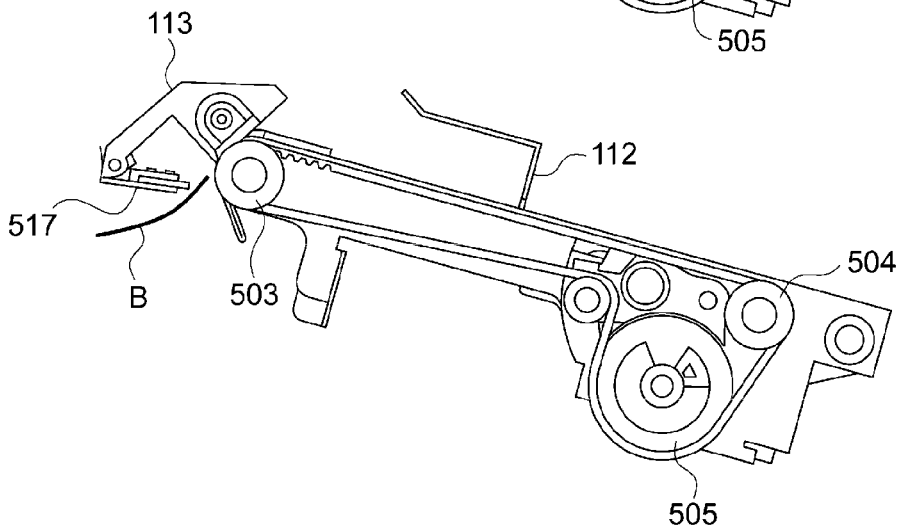

FIGS. 11A-11B, 12A-12C are a diagram illustrating an operation of the discharging projection 113 and the rear end assist 112 of the sheet bundle discharging unit. FIGS. 11A-11B show a state before the discharging projection 113 begins to move. FIG. 11A shows a state before the rear end assist 112 begins to move. FIG. 11B shows a state where the rear end assist 112 has begun to move. FIGS. 12A-12C show a state after the discharging projection 113 has begun to move. FIG. 12A shows a state where the discharging projection 113 began to move. FIG. 12B shows a state where the discharging projection 113 has overtaken the rear end assist 112. FIG. 12C shows a state immediately after the discharging projection 113 discharges the sheet bundle B.

As shown in FIG. 11A, firstly, with the cam 516 being coupled to the assist cam shaft 511 as the center of rotation of the cam pulley 505, the assist motor M254 is driven.

Therefore, as shown in FIG. 11B, the rear end assist 112 moves in the direction of arrow X and the assist cam shaft 511 rotates in the direction of the arrow Y. At this time, the driving force is not transmitted to the cam pulley 505 for a certain period of time owing to the cam pulley 505 provided with the void portion 505*g*.

Thereafter, as shown in FIG. 12A, the cam 516 abuts against the rib face 505*a* of the cam pulley 505, thereby the cam pulley 505 is rotated in the direction of the arrow Y and the discharging projection 113 begins to move in the direction of the arrow Z.

A pulley ratio is set in such a way that a moving speed of the discharging projection 113 is higher than a moving speed of the rear end assist 112, thereby, as shown in FIG. 12B, the discharging projection 113 is configured to overtake the rear end assist 112 during movement. In this way, a timing is set in such a way that the discharging projection 113 overtakes the rear end assist 112 after the rear end assist 112 moves in the sheet conveying downstream direction and passes the pulley 504. As a result, the delivery of the sheet bundle B is carried out smoothly.

Subsequently, the discharging projection 113 which has overtaken the rear end assist 112 pushes the sheet bundle B to the position over the pulley 503, thereby the sheet bundle B is discharged on the stacking tray 114 provided further downstream than the pulley 503 in the rotation direction of the discharging projection belt 502.

Figure 13:
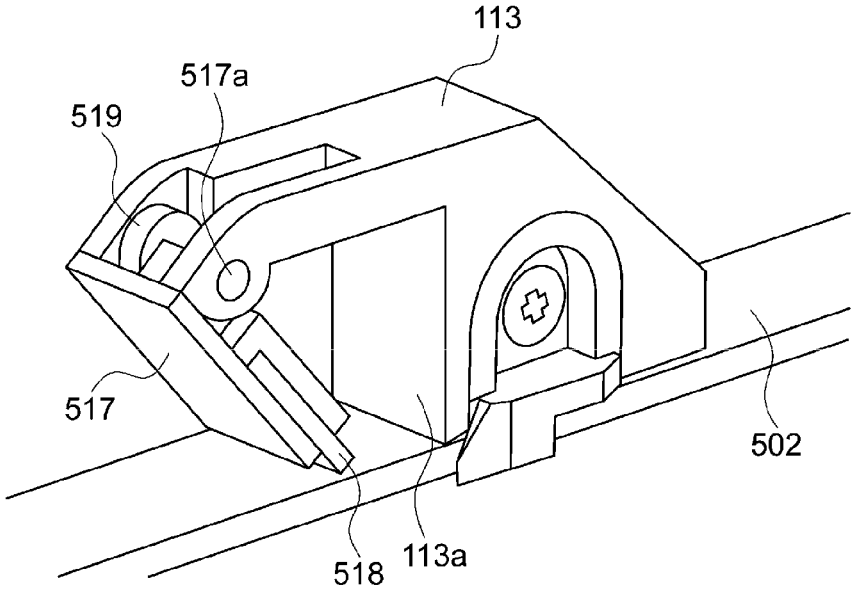
FIG. 13 is a perspective view of the discharging projection of the image forming apparatus of the first embodiment of the present invention.

(Structure of the discharging projection) Next, the structure of the discharging projection will be explained. FIG. 13 is a perspective view of the discharging projection 113.

As shown in the figure, distal lever 517 (pressing portion) is provided at the distal end of the downstream side of the sheet conveying direction of the discharging projection 113. Distal lever 517 is rotatable about the rotation center 517*a* (rotation axis) and can be moved upward when discharging the sheet bundle having many sheets. The rubber member (contact member) which has a higher coefficient of friction than that of the discharging projection 113 is attached to the lower end portion of the distal lever 517 so as to be in contact with the sheet bundle B during discharging operation. The torsion coil spring 519 (biasing member) is disposed on the center of rotation 517*a* of the distal lever 517, thereby a force is applied to the lower end of the distal lever 517 in the direction of coming in contact with the sheet.

By providing a rubber member 518 having a high friction coefficient in the distal end portion of the distal lever 517 in this manner, it is possible to prevent the sheet from jumping out due to the inertia force of the sheet itself when the discharging projection 113 is decelerated or stopped around the stacking tray 114. A friction coefficient of the inclination portion is lower than that of the rubber member 518.

The discharging projection 113 has the surface 113*a* (abutting portion) for pushing the rear end of the sheet bundle B. The distal lever 517 is attached to the discharging projection 113 via a rotating shaft which is disposed at an upper portion of the pressing surface 113 and downstream of the sheet conveying direction. The distal lever 517 is rotatable around the rotational center 517*a*. The distal lever 517 is configured to stop its rotation at the position where the distal lever 517 is inclined at a predetermined angle downstream of the sheet conveying direction in such a way that the lower end of the distal lever 517 approaches the pushing surface 113*a*. That is, the distal end of the distal lever 517, which comes in contact with the sheet, is positioned further upstream in the sheet conveying direction of the discharging projection 113 than the rotation center 517*a* which serves as a portion for attaching the distal lever 517 to the discharging projection 113. The distal lever 517 has an inclined surface which is inclined with respect to a holding surface of the processing tray 107. This inclined surface is configured to be inclined in such a way that as a position on the inclined surface goes further upstream in the sheet discharging direction, the position approaches more the processing tray 107.

Thus, while the discharging projection 113 pushes the sheet bundle B, the distal lever 517 presses the sheet bundle B against the conveying surface during transport. Thereby suppressing deflection of the rear ends of the sheets during the transport of the sheets and making it possible to prevent the sheets from jumping out due to the inertia force of the sheets when the discharging projection 113 is stopped or decelerated while discharging the sheets on the stacking tray 114.

Figure 14:
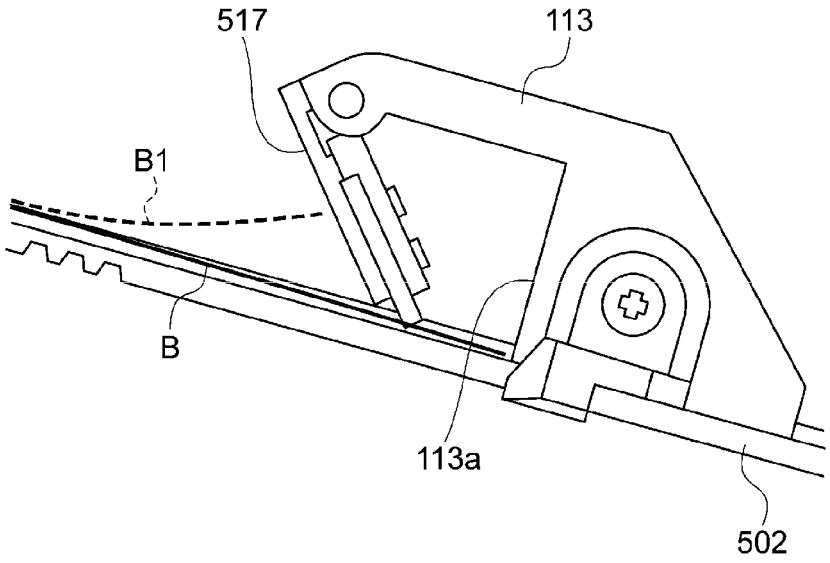
FIG. 14 is a diagram illustrating a state where a rear end of a sheet bundle is curled in an upper direction when the sheet bundle is delivered from the rear end assist to the discharging projection in the image forming apparatus of the first embodiment of the present invention.

FIG. 14 is a diagram illustrating a state where the rear end of the sheet bundle B is curled in the upper direction when the sheet bundle B is delivered from the rear end assist 112 to the discharging projection 113.

As shown in the diagram, even if the rear end of the sheet bundle B1 is curled in the upper direction, the distal lever 517 is inclined with respect to the pushing surface 113*a*. Thus, when the sheet bundle B is delivered from the rear end assist 112 to the discharging projection 113, the sheet bundle B can be smoothly introduced to the pushing surface 113*a*.

Further, when the sheet bundle B is conveyed parallel to the conveying surface, a force is applied to the conveying surface of the sheet bundle B due to inclination of the distal lever 517. Meanwhile, a force toward the conveying surface is applied to the distal lever 517 by the torsion coil spring 519, but is restricted to rotate at a predetermined position by a stopper (not shown) to maintain the inclined state with respect to the pushing surface 113*a*. Therefore, during discharging of the sheet bundle B when the discharging projection 113 reaches the pulley 503 which stretches the discharging projection belt 502 and which is located downstream in the rotation direction of the belt, the distal end of the distal lever 517 becomes away from the sheet as shown in FIG. 12C. Then, a space for releasing the rear end of the sheet bundle B is formed by an arc portion corresponding to the pulley 503 thereby releasing the sheet smoothly.

(Post-processing operation) Next, an explanation will be made about post-processing operations of the post-processing performing unit of this embodiment for binding the sheet bundle B with the stapler.

Figure 15:
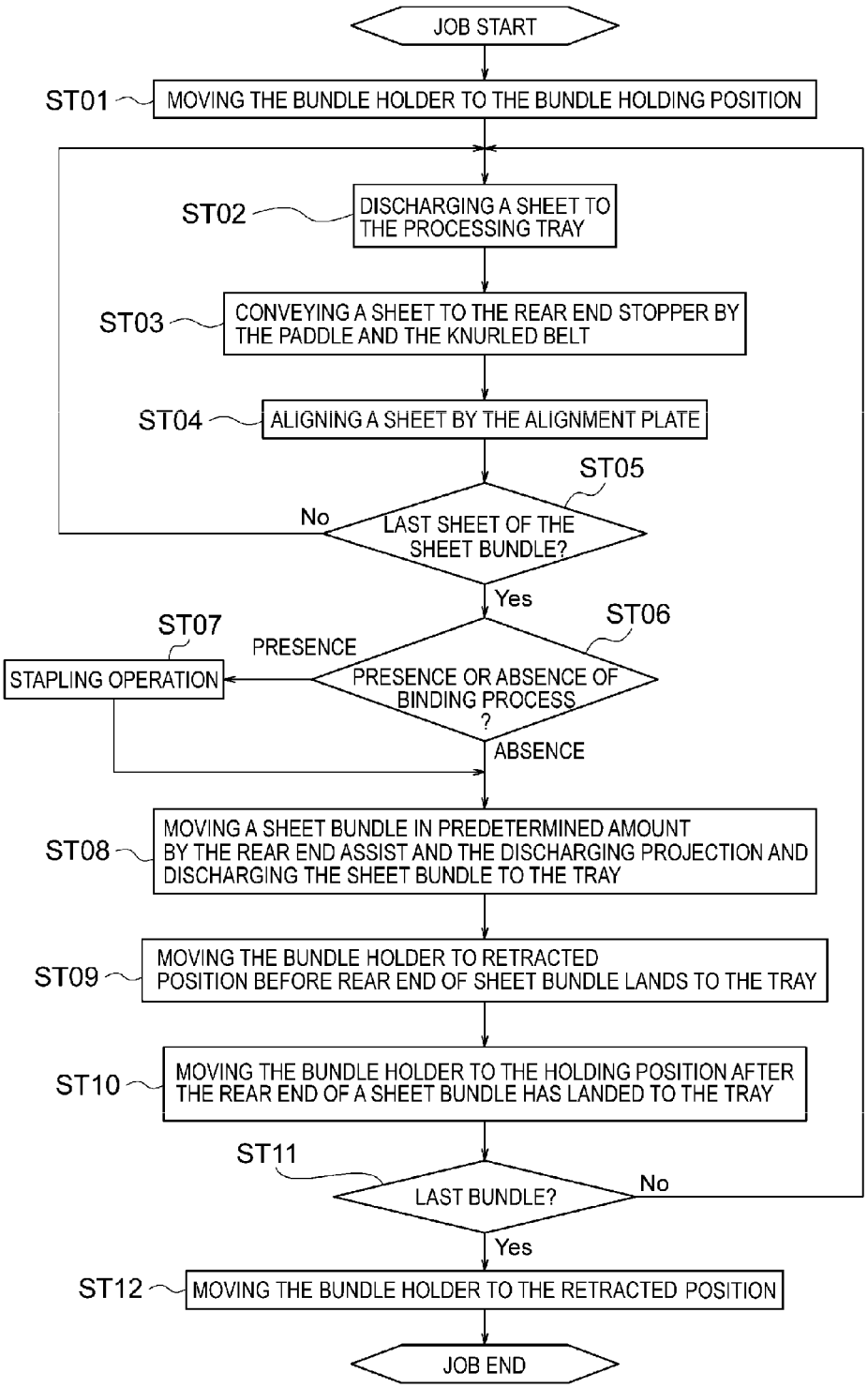
FIG. 15 is a flowchart showing an operation of a binding job as a post-processing operation in the image forming apparatus of the first embodiment of the present invention.

FIG. 15 is a flowchart showing an operation of a binding job as a post-processing operation.

When a job is started, the bundle holder 115 is moved to the bundle holding position (step ST01). Thereafter, the sheet is discharged to the processing tray 107 (step ST02). Next, the sheet is conveyed to the rear end stopper 108 by the paddle 106 and the knurled belt 111 (step ST03). Then, the sheet is aligned by the alignment plate 109 (step ST04). Next, it is determined whether the sheet P is the last of the sheet bundle B (step ST05) and if it is not the last sheet, the process returns to the step ST02.

After all the sheets P for the sheet bundle B are loaded and aligned in this way, the presence or absence of a binding process is determined (step ST06). If a stapling operation is required, it is performed (step ST07) and if it is not required, it is not performed.

Then, the sheet bundle is delivered to the discharging projection 113 from the rear end assist 112. After the rear end assist 112 moves in the predetermined amount of the movement after the sensor flag of the rear assist 112 passes through the assist position sensor S244, the driving of the rear end assist 112 is stopped (step ST08), thereby the sheet bundle B is discharged onto the stacking tray 114. At this time, the bundle holder 115 is moved to the retracted position from the stacking tray 114 before the rear end of the sheet bundle B lands to the stacking tray 114 (step ST09). After the rear end of the sheet bundle B has landed to the stacking tray 114, the bundle holder 115 is moved to the holding position again (step ST10) in order to prepare for holding the next sheet bundle B.

Next, it is determined whether the sheet bundle B is the last bundle (step ST11). If it is not the last bundle, the process returns to the step ST02 where processing of the next sheet bundle B is performed. If it is the last bundle, the bundle holder 115 is moved to the retracted position after the last bundle is discharged (step ST12). This is for the user to easily take the sheet bundle from the stacking tray 114.

In the description described above, the configuration is adopted in which the sheet bundle B on the processing tray 107 is discharged onto the stacking tray 114 by the discharging projection 113. However, without providing the stacking tray 114, it may be configured that the sheet bundle B is moved and stopped within the processing tray 107. Even in this case, it is possible to suppress deviation of the sheet within the processing tray 107, caused by jumping of the sheet bundle B from the discharging projection 113.

Further, even if the stop position of the rotation of the distal lever 517 attached to the distal end of the discharging projection 113 is configured not to be inclined with respect to the conveying surface of the sheet bundle B in such a way that the distal lever 517 stops perpendicular to the conveying surface, the sheet bundle B can be prevented from jumping out due to the inertia force of itself.

Second Embodiment

Next, an image forming apparatus of another embodiment of the present invention will be described. For many parts of the image forming apparatus of the first embodiment are common, this embodiment describes only differences from the first embodiment. The other part is the same configuration as the first embodiment. The same reference numerals are used for the same components as the first embodiment, and redundant explanations are omitted.

Figure 16A:
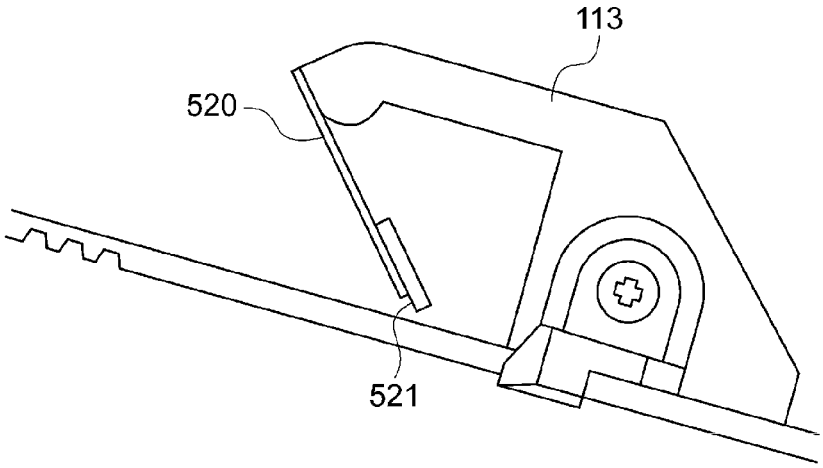
FIGS. 16A and 16B are diagrams showing a configuration of a discharging projection of the image forming apparatus of the second embodiment of the present invention.
Figure 16B:
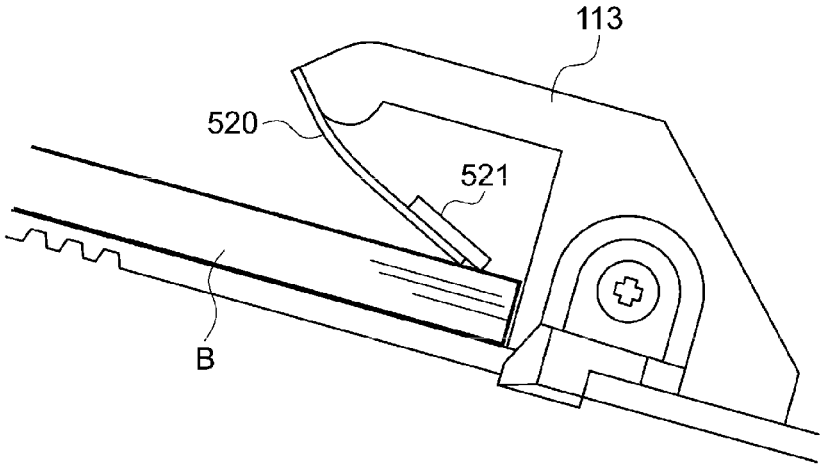

FIGS. 16A and 16B are a diagram showing a configuration of discharging projection 113 of the present embodiment. FIG. 16A shows a state in which the sheet bundle B is not inserted in the discharging projection 113 and FIG. 16B shows a state in which the sheet bundle B is inserted in the discharging projection 113.

According to the first embodiment, if the thickness of the sheet bundle B is large, the sheet bundle B is accepted by the movement in the retracted direction of the distal lever 517 which rotates around the predetermined rotation center of the discharging projection 113.

On the other hand, as shown in FIG. 16A, the present embodiment employs the sheet material 520 which is an elastic member in place of the distal lever 517. When the thick sheet bundle B is inserted in the discharging projection 113 as shown in FIG. 16B, the sheet bundle B is accepted by the bent sheet material 520. Further, with provision of a rubber member 521 having a high friction coefficient placed at the distal end portion of the sheet material 520, even when the discharging projection 113 is stopped or decelerated during discharging operation of the sheet bundle B to the stacking tray 114, the sheet bundle B can be prevented similarly as the first embodiment from jumping out caused by the inertia force of the sheet bundle B.

Third Embodiment

Next, an image forming apparatus of another embodiment of the present invention will be described. For many parts of the image forming apparatus of the first embodiment are common, this embodiment describes only differences from the first embodiment. The other part is the same configuration as the first embodiment. The same reference numerals are used for the same components as the first embodiment, and redundant explanations are omitted.

Figure 17:
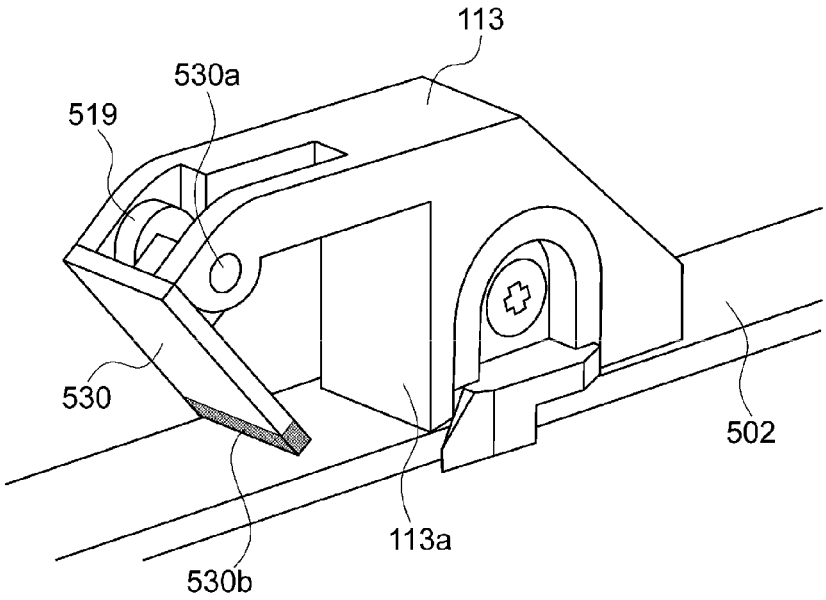
FIG. 17 is a diagram showing a configuration of a discharging projection of the image forming apparatus of the third embodiment of the present invention.
Figure 18:
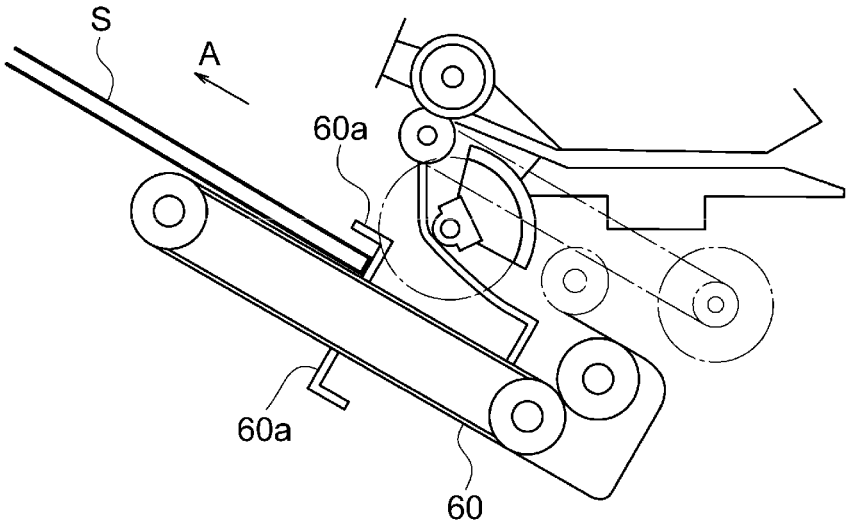
FIG. 18 PRIOR ART
FIG. 18 is a diagram showing a configuration of a portion for conveying a sheet during post-processing of an image forming apparatus of a prior art.
Figure 19A:
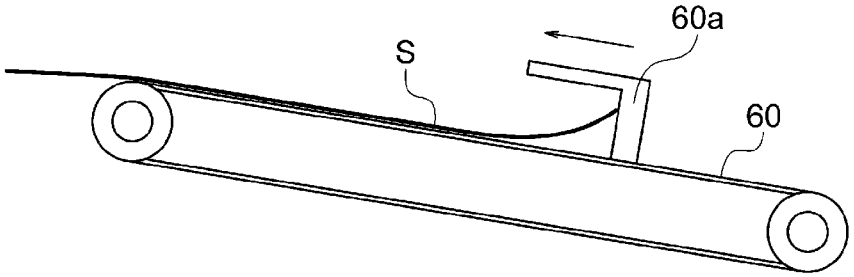
FIG. 19A PRIOR ART
FIGS. 19A and 19B are diagrams showing states of pushing a rear end of a sheet bundle by a sheet bundle pushing member in the image forming apparatus of the prior art shown in FIG. 18.
Figure 19B:
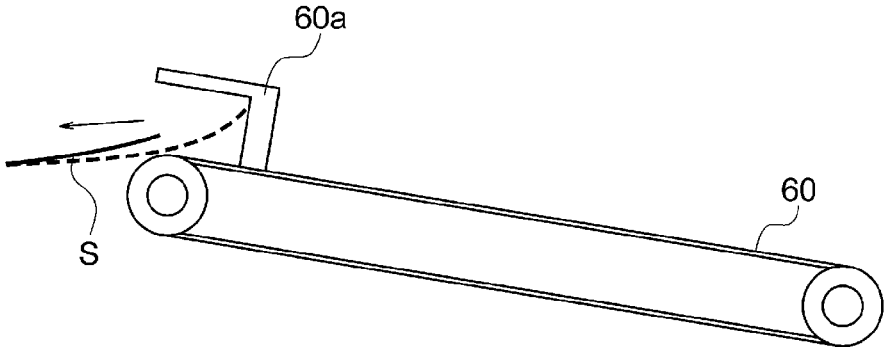
FIG. 19B PRIOR ART

FIG. 17 is a diagram showing a configuration of discharging projection 113 of the present embodiment.

As shown in the diagram, the discharging projection 113 of the present embodiment is provided with the distal lever 530 made of rubber. The distal lever 530 is configured to rotate around the rotation center 530*a* (rotation axis), and is movable in the upward direction when discharging the sheet bundle having many sheets. Irregularities or grooves are formed at the distal end portion 530*b* of the lower end of the lever 530 so that a friction coefficient of the lower end is higher than that of the rest of the distal lever 530. Further, the friction coefficient of the distal end portion 530*b* is higher than that of the discharging projection 113. The torsion coil spring 519 (biasing member) is disposed on the rotation center 530*a* of the distal lever 530 and the torsion coil spring 519 applies a force to the distal end portion 530*b* (contacting portion) in the direction in which the distal end portion 530*b* comes in contact with the sheet.

By increasing the coefficient of friction of the distal end portion 530*b* of the distal lever 530 in this manner, it is possible to prevent the sheet from jumping out due to the inertia force of the sheet itself when the discharging projection 113 is decelerated or stopped around the stacking tray 114.

In the present embodiment, the distal lever 530 is made of rubber but it may also be a mold member on the distal end portion (the contact portion) on which irregularities or grooves are formed for making a friction coefficient of the distal end portion higher than that of the rest of the distal lever 530.

While the present invention has been described with reference to exemplary embodiments, it is to be understood that the invention is not limited to the disclosed exemplary embodiments. The scope of the following claims is to be accorded the broadest interpretation so as to encompass all such modifications, equivalent structures and functions.

This application claims the benefit of Japanese Patent Application No. 2013-136300, filed Jun. 28, 2013, which is hereby incorporated by reference herein in its entirety.

What is claimed is:

1. A sheet conveying apparatus comprising:

a supporting portion which supports a sheet;

a sheet conveying portion which includes an abutting portion for abutting against an end portion of the sheet supported by the supporting portion and which conveys the sheet being abutted against the abutting portion by moving in a predetermined moving direction; and a pressing portion which is rotatably provided around a rotation axis, which is movable in a thickness direction of the sheet, and which presses the sheet toward the supporting portion, wherein the pressing portion includes:

an inclined portion arranged in a manner so as to be closer to the supporting portion at an upstream side in the predetermined moving direction than a downstream side in the predetermined moving direction, and a contacting portion configured to contact a surface of the sheet being abutted against the abutting portion to press the sheet to the supporting portion at a position distant from the abutting portion, and wherein the contacting portion is positioned further upstream of the predetermined moving direction than the rotation axis.

2. A sheet conveying apparatus according to claim 1, further comprising a biasing member which applies a force to the pressing portion such that the contacting portion abuts against the sheet when the sheet conveying portion conveys the sheet.

3. A sheet conveying apparatus according to claim 2, wherein the friction coefficient between the contacting portion and the sheet is higher than that between the inclined portion and the sheet.

4. A sheet conveying apparatus according to claim 1, wherein the pressing portion includes an elastic member, and wherein the contacting portion is movable in a thickness direction of the sheet by elasticity of the elastic member.

5. A sheet conveying apparatus according to claim 4, wherein the elastic member includes the inclined portion.

6. A sheet conveying apparatus according to claim 5, wherein the contacting portion has a higher friction coefficient for the sheet than the inclined portion.

7. A sheet conveying apparatus according to claim 1, wherein the sheet conveying portion is provided as at least two sheet conveying portions, both of which are the same, provided in a width direction perpendicular to the predetermined moving direction.

8. A sheet conveying apparatus according to claim 1, wherein a sheet bundle composed of a plurality of sheets is stacked on the supporting portion, wherein the sheet conveying portion conveys the sheet bundle by the abutting portion which abuts against an end portion of the sheet bundle supported by the supporting portion, and wherein the contacting portion holds the sheet bundle by contacting a surface of the sheet bundle when the sheet bundle is conveyed.

9. A sheet conveying apparatus according to claim 8, further comprising a sheet aligning portion which aligns positions in a width direction of sheets of the sheet bundle stacked on the supporting portion.

10. A sheet conveying apparatus according to claim 8, further comprising a post-processing performing unit which performs, on the supporting portion, a predetermined post-processing for the sheet bundle stacked on the supporting portion.

11. A sheet conveying apparatus according to claim 10, wherein the post-processing performing unit performs at least a process of binding the sheet bundle.

12. A sheet conveying apparatus according to claim 1, wherein the sheet conveying portion is provided on an endless belt rotatably stretched on at least two rotating members such that a surface of the endless belt is formed along a sheet stacking surface of the supporting portion, and wherein the abutting portion is positioned away from the sheet when the sheet conveying portion reaches a rotating member which is placed the furthest in the predetermined moving direction of the at least two rotating members.

13. A sheet conveying apparatus according to claim 12, further comprising a stacking portion where the sheet discharged from the sheet conveying portion is stacked.

14. A sheet conveying apparatus according to claim 1, wherein a surface of the contacting portion includes irregularities so as to prevent movement of the sheet when the contacting portion presses the sheet to the supporting portion.

15. A sheet conveying apparatus comprising:

a supporting portion which supports a sheet;

a sheet conveying portion which includes an abutting portion for abutting against an end portion of the sheet supported by the supporting portion and which conveys the sheet being abutted against the abutting portion by moving in a predetermined moving direction; and a pressing portion which is provided on the sheet conveying portion, which is movable in a thickness direction of the sheet, and which presses the sheet toward the supporting portion, wherein the pressing portion includes:

an inclined portion arranged in a manner so as to be closer to the supporting portion at an upstream side in the predetermined moving direction than a downstream side in the predetermined moving direction, and a contacting portion configured to contact a surface of the sheet being abutted against the abutting portion to press the sheet to the supporting portion at a position distant from the abutting portion, wherein the pressing portion is rotatably provided around a rotation axis, wherein the contacting portion is positioned further upstream in the predetermined moving direction than the rotation axis, and wherein the inclined portion is formed of a material different from that of the contacting portion.

16. A sheet conveying apparatus according to claim 15, wherein the contacting portion is formed of rubber.

17. A sheet conveying apparatus according to claim 15, further comprising a biasing member which applies a force to the pressing portion such that the contacting portion abuts against the sheet when the discharging portion conveys the sheet.

18. An image forming apparatus comprising:

an image forming portion which forms an image on a sheet; and the sheet conveying apparatus according to claim 15, which conveys the sheet on which an image is formed by the image forming portion.

19. A sheet conveying apparatus according to claim 15, wherein the sheet conveying portion is provided as at least two sheet conveying portions, both of which are the same, provided in a width direction perpendicular to the predetermined moving direction.

20. A sheet conveying apparatus according to claim 15, wherein a sheet bundle composed of a plurality of sheets is stacked on the supporting portion, wherein the sheet conveying portion conveys the sheet bundle by the abutting portion which abuts against an end portion of the sheet bundle supported by the supporting portion, and wherein the contacting portion holds the sheet bundle by contacting a surface of the sheet bundle when the sheet bundle is conveyed.

21. A sheet conveying apparatus according to claim 15, wherein the sheet conveying portion is provided on an endless belt rotatably stretched on at least two rotating members such that a surface of the endless belt is formed along a sheet stacking surface of the supporting portion, and wherein the abutting portion is positioned away from the sheet when the sheet conveying portion reaches a rotating member which is placed the furthest in the predetermined moving direction of the at least two rotating members.

* * * * *